US005876893A

United States Patent [19]

Ochiai et al.

[11] Patent Number: 5,876,893

[45] Date of Patent: Mar. 2, 1999

[54] FERRITE CARRIER, TWO-COMPONENT DEVELOPER AND ELECTROSTATIC IMAGING METHOD USING THE DEVELOPER

[75] Inventors: Masahisa Ochiai, Fukaya; Masumi Asanae; Tsutomu Saitoh, both of Kumagaya; Takashi Hayano, Honjo, all of Japan

[73] Assignee: Hitachi Metals, Ltd., Tokyo, Japan

[21] Appl. No.: 805,609

[22] Filed: Feb. 25, 1997

[30] Foreign Application Priority Data

| | | | |
|---|---|---|---|
| Mar. 1, 1996 | [JP] | Japan | 8-044601 |
| Mar. 1, 1996 | [JP] | Japan | 8-044602 |
| Mar. 1, 1996 | [JP] | Japan | 8-044604 |
| Mar. 1, 1996 | [JP] | Japan | 8-044606 |
| May 15, 1996 | [JP] | Japan | 8-119840 |

[51] Int. Cl.[6] ..... G03G 9/107

[52] U.S. Cl. ..... 430/106.6; 430/108

[58] Field of Search ..... 430/106.6, 108

[56] References Cited

U.S. PATENT DOCUMENTS

| | | | |
|---|---|---|---|
| 4,898,801 | 2/1990 | Tachibawa et al. | 430/106.6 |
| 5,422,216 | 6/1995 | Smith et al. | 430/106.6 |
| 5,466,552 | 11/1995 | Sato et al. | 430/106.6 |

FOREIGN PATENT DOCUMENTS

| | | |
|---|---|---|
| 58-215664 | 12/1983 | Japan . |
| 62-297857 | 6/1986 | Japan . |
| 61-200551 | 9/1986 | Japan . |
| 3-33758 | 2/1991 | Japan . |
| 7-225497 | 8/1995 | Japan . |
| 8-6304 | 1/1996 | Japan . |

*Primary Examiner*—John Goodrow

*Attorney, Agent, or Firm*—Morgan, Lewis & Bockius LLP

[57] ABSTRACT

An Li—Mn ferrite carrier comprising 2 to 15 mol % of $Li_2O$, 5 to 30 mol % of MnO and 60 to 90 mol % of $Fe_2O_3$. The carrier may contain at least one sintering aid selected from the group consisting of CaO, $Na_2O$, $SiO_2$, $V_2O_5$, $Al_2O_3$, $As_2O_3$, $Bi_2O_3$, $Sb_2O_3$ and $B_2O_3$ to improve the surface properties thereof. The carrier may be made sensitive to the intensity of electric field by regulating the specific volume resistivities at 200 V/cm and 10 kV/cm within the specific ranges. This carrier is particularly suitable in the reversal developing method, and in the developing method where an A.C. bias voltage is superimposed to a D.C. bias voltage.

14 Claims, 1 Drawing Sheet

FERRITE CARRIER, TWO-COMPONENT DEVELOPER AND ELECTROSTATIC IMAGING METHOD USING THE DEVELOPER

BACKGROUND OF THE INVENTION

The present invention relates to a magnetic carrier made of Li—Mn ferrite for use in a two-component developer which is used for developing electrostatic latent images formed on a surface of an image-bearing member (photosensitive drum) of image-forming apparatus such as laser beam printers, dry copying machines, etc. The present invention further relates to a two-component developer containing the Li—Mn ferrite carrier. The present invention still further relates to a method of developing electrostatic latent images by using a two-component developer containing the Li—Mn ferrite carrier.

In electrophotographic recording apparatus, it is known that a visual toner image is produced by the successive steps, for example, of (1) forming an electrostatic latent image corresponding to original image or information data, for instance, on a photosensitive surface of a cylindrical photosensitive drum (image-bearing member), (2) magnetically attracting a magnetic developer on a rotating developing roll equipped with an inner permanent magnet and disposed opposing the photosensitive drum, (3) delivering the magnetic developer, while forming a magnetic brush, to a developing zone where the electrostatic latent image on the photoconductive drum is slidingly brushed with the magnetic brush to produce toner images. The developed image is then transferred to a recording sheet and fixed thereon by heating or applying pressure As the developer, one-component developer containing only a toner or two-component which is a mixture of a toner and a magnetic carrier has been used. In the two-component developer development, when the toner and the magnetic carrier are mixed together in a predetermined mixing ratio, the toner and the magnetic carrier acquire triboelectric charges of opposite polarities to allow the toner to cling to the magnetic carrier by electrostatic attraction. The magnetic carrier electrostatically retaining the toner is then supplied on the surface of a developing roller to form rotating magnetic brushes. The photoconductive surface containing the latent images is brought into brushing contact with the rotating magnetic brushes. During the brushing contact, only the toner is deposited on the image areas by electrostatic attraction between the latent image and the toner to produce visual toner images.

Generally, the two-component developer is required to have a good stability in image quality and to maintain such a stability against a continuous developing operation. To attain this long stability, it is necessary to regulate the ability of the carrier to providing the toner with triboelectric charges and the electric resistance of the developer within a suitable level. In addition, it is desirable that the ability and the electric resistance are not changed even in a long developing operation.

The toner is usually produced by blending a binder resin with several additives such as a colorant including dyestuff and pigment, a magnetic powder, a charge controlling agent, a wax, etc. to disperse the additives in the binder resin. To make the electric resistance of the developer stable, it has been considered to select suitable binder resin, charge controlling agent and other additives. As the material for the carrier, iron powder and a ferrite powder have been mainly used. To ensure a stable ability of providing the toner with a suitable amount of triboelectric charges, several considerations have been made in oxidation treatment of iron powder, material for the ferrite powder, the surface property of the powder, materiel for a coating, a method of coating, etc.

The iron carrier is usually produced by subjecting to its surface a suitable treatment such as oxidation treatment. The iron carrier subjected to such a treatment physically or chemically changes its surface conditions in a developing operation of a long period of time to make the toner cling thereon, thereby causing several defects of a decreasing ability of providing the toner with a sufficient triboelectric charges, a reduction in the resolution of produced images due to a high susceptibility to a moisture of the environment, and a short durability.

The ferrite carrier has become to be used in place of the iron carrier because it is chemically more stable than the iron carrier, it less changes its electric resistance during the use and its apparent density is about ⅔ of that of the iron carrier.

The ferrite carrier is a sintered product of a complete mixture of an iron (III) oxide and an oxide of at least one element such as Ni, Zn, Mn, Mg, Cu, Li, Ba, V, Cr, Ca, etc., and the practically used may include an Ni—Zn ferrite, an Mn—Zn ferrite and a Cu—Zn ferrite.

However, Zn, Ni, etc. are noxious to human body and the disposal of waste ferrite carrier containing such elements is legislatively regulated. The Li—Mn ferrite is not needed to be legislatively regulated, and therefore, such an advantage of the Li—Mn ferrite carrier is recently noted in the art. However, since the optimal chemical composition and the optimal developing conditions have not yet been established, it is difficult at present to stably reproduce images of a high quality by the use of a developer containing the Li—Mn carrier in a continuous developing operation.

In laser beam printers, digital copying machines, etc. which are coming to be widely used, a reversal developing method is usually employed, in which the latent image is formed by exposing a uniformly charged photoconductive surface to lights to discharge the image areas and remain nonimage areas charged. In the reversal developing method, a toner charged to the same polarity as that of the photoconductive surface is deposited on the latent image having a potential of about zero volt. Therefore, a high bias voltage is required to be applied between the developing roll and the photoconductive surface to sufficiently deposit the toner on the latent image. If the specific volume resistivity of the carrier is low, the carrier is likely to adhere to the photosensitive surface. On the other hand, a solid black images of uneven density is reproduced due to a strong edge effect if the specific volume resistivity of the carrier is high. Therefore, the carrier is required to have a low specific volume resistivity in the developing zone where the carrier is exposed to a high electric field due to the high bias voltage. Also, it is desirable for the carrier to have a high specific volume resistivity in the region other than the developing zone, because the charge amount of the toner is reduced due to leak if the specific volume resistivity is low. Thus, the specific volume resistivity of the carrier is preferred to be high in a low electric field, and low in a high electric field. However, the carrier in the prior art is insensitive to the change of the electric field.

Generally, the ability of the ferrite carrier to provide the toner with triboelectric charge largely depends on the chemical composition of the carrier. The known Ni—Zn ferrite, Mn—Zn ferrite, Cu—Zn ferrite, etc. provide a polyester-based toner of a strong negative chargeability with too much amount of charge which results in a reproduced image with insufficient density and a charge-up. Also, such ferrite carriers are less effective to charge a positively chargeable toner such as a styrene-acryl-based toner, and produce images with background foggings.

OBJECT AND SUMMARY OF THE INVENTION

Accordingly, an object of the present invention is to provide an Li—Mn ferrite carrier containing no noxious element and free from the above problems in the prior art.

Another object of the present invention is to provide a two-component developer comprising a toner and an Li—Mn ferrite carrier containing no noxious element.

Still another object of the present invention is to provide a method of developing electrostatic latent images to obtain a high quality image with using an Li—Mn ferrite carrier containing no noxious element.

As a result of the intense research in view of the above objects, the inventors have found that an Li—Mn ferrite carrier having a chemical composition of 2 to 15 mol % of $Li_2O$, 5 to 30 mol % of MnO and 60 to 90 mol % of $Fe_2O_3$, each based on the total of $Li_2O$, MnO and $Fe_2O_3$, can remove the above problems by making the surface of the Li—Mn ferrite uniform by sintering the ferrite material in the presence of at least one sintering aid selected from the group consisting of oxides of Ca, Na, Si, V, Al, As, Bi, Sb and B. The inventors have further found that a ferrite carrier having a specific volume resistivity sensitive to the change of electric field can be obtained from an Li—Mn ferrite carrier having the above chemical composition and a particular ratio of the specific volume resistivities, each measured at respective electric fields of D.C. 200 V/cm and D.C. 10 kV/cm. Still further, the inventors have found that a two-component developer containing the Li—Mn ferrite carrier is suitable for the developing method where a bias voltage is applied between the photosensitive surface and the sleeve of the developing roll. The present invention has been accomplished based on these findings.

Thus, in a first aspect of the present invention, there is provided a ferrite carrier comprising 2 to 15 mol % of $Li_2O$, 5 to 30 mol % of MnO and 60 to 90 mol % of $Fe_2O_3$, each molar percentage being based on the total of $Li_2O$, MnO and $Fe_2O_3$, and containing at least one sintering aid selected from the group consisting of CaO, $Na_2O$, $SiO_2$, $V_2O_5$, $A1_2O_3$, $As_2O_3$, $Bi_2O_3$, $Sb_2O_3$ and $B_2O_3$ in an amount of 0.1 to 1.2 weight % based on the total of $Li_2O$, MnO and $Fe_2O_3$, the ferrite carrier having an average particle size of 10 to 150 $\mu$m and a specific volume resistivity of $10^6$ to $10^{10}$ $\Omega\cdot$cm when measured at an electric field of 200 V/cm.

In a second aspect of the present invention, there is provided a ferrite carrier comprising 2 to 15 mol % of $Li_2O$, 5 to 30 mol % of MnO and 60 to 90 mol % of $Fe_2O_3$, each molar percentage being based on the total of $Li_2O$, MnO and $Fe_2O_3$, wherein an average particle size of the carrier is 10 to 150 $\mu$m, a specific volume resistivity ($R_1$) of the carrier measured at an electric field of 200 V/cm is $10^5$ to $10^{13}$ $\Omega\cdot$cm, and a ratio ($R_1/R_2$) of $R_1$ and a specific volume resistivity ($R_2$) of the carrier measured at an electric field of 10 kV/cm is 10 or more.

In a third aspect of the present invention, there is provided a two-component developer comprising the Li—Mn ferrite carrier as described above and a negative or positive chargeable toner.

In a fourth aspect of the present invention, there is provided a method of developing electrostatic latent image by using a developer containing the Li—Mn ferrite carrier described above while applying a bias voltage between the photosensitive drum and the sleeve, the bias voltage being D.C. bias voltage superimposed with A.C. bias voltage having a peak-to-peak voltage of 500 V to 2.5 kV and a frequency of 100 Hz to 10 kHz.

DETAILED DESCRIPTION OF THE INVENTION

A. Carrier

Figure 1:
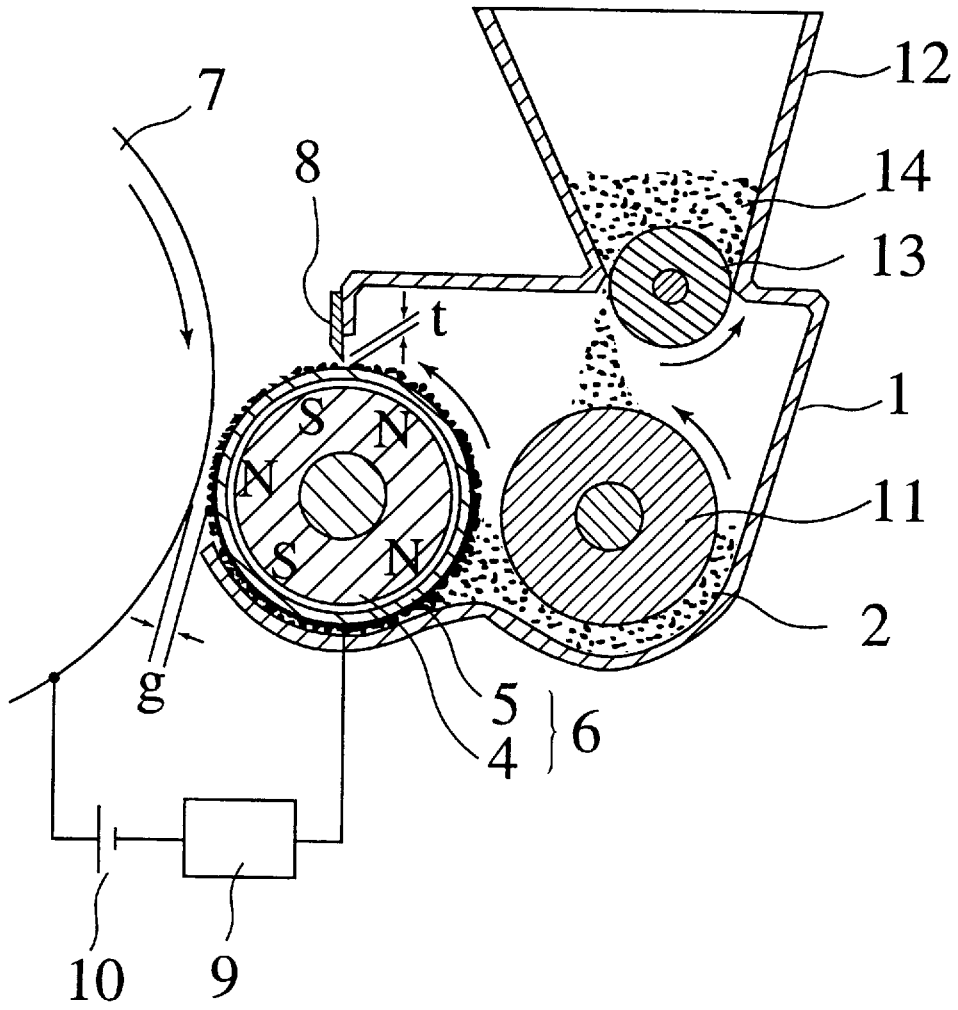
FIG. 1 is a schematic view for illustrating a developing apparatus embodying the present invention.

The Li—Mn ferrite carrier of the present invention, which has a spinel structure, comprises 2 to 15 mol %, preferably 4 to 12 mol % of $Li_2O$, 5 to 30 mol %, preferably 8 to 26 mol % of MnO, and 60 to 90 mol %, preferably 65 to 85 mol % of $Fe_2O_3$. Each molar percentage is based on the total of $Li_2O$, MnO and $Fe_2O_3$.

An amount less than 2 mol % of $Li_2O$ is disadvantageous because the resultant carrier cannot charge the toner to a sufficient level, the specific volume resistivity becomes too high, thereby resulting in reduced image density, and an uneven solid black image is produced due to a high edge effect. When the amount exceeds 15 mol %, the specific volume resistivity is significantly lowered to likely cause carrier adhesion (adhesion of the carrier on the photosensitive drum surface).

The addition of MnO contributes to increasing the saturation magnetization. When the amount of MnO is less than 5 mol %, the saturation magnetization of the resultant carrier is low, and the carrier adhesion is likely to occur. An amount larger than 30 mol % is not desirable because too a high saturation magnetization of the carrier makes the magnetic brush so rigid that the surface of the photoconductive drum (image-bearing member) is hardly scratched or rubbed by the rigid magnetic brush to likely cause unfavorable brush marks in the reproduced images.

An amount of $Fe_2O_3$ less than 60 mol % reduces the saturation magnetization of the resultant carrier to result in a low image density and the carrier adhesion. When the amount exceeds 90 mol %, brush marks are likely to occur because the saturation magnetization is too high.

The Li—Mn ferrite carrier of the present invention may contain a sintering aid to densify the sintered product thereby making the surface of the sintered product (carrier) uniform. The amount to be added is 0.1 to 1.2 weight %, preferably 0.3 to 0.7 weight % based on the total of $Li_2O$, MnO and $Fe_2O_3$. By using the sintering aid, the crystal structure of the ferrite carrier is made finer and the average grain size of 20 $\mu$m or less is attained. Such a sintering aid is at least one oxide of elements selected from the group consisting of Ca, Na, Si, V, Al, As, Bi, Sb and B, preferably at least one oxide of Ca, Na, Si, V and Al. The oxides may include CaO, $Na_2O$, $SiO_2$, $V_2O_5$, $Al_2O_3$, $As_2O_3$, $Bi_2O_3$, $Sb_2O_3$ and $B_2O_3$. A metal compound which changes to the oxide mentioned above during the sintering process may be also used as the sintering aid in place of the oxide. Such a metal compound may include $CaCl_2$,$CaCO_3$, etc. When the addition amount of the sintering aid is less than 0.1 weight %, no detectable effect of adding the sintering aid is obtained. An addition amount exceeding 1.2 weight % is not desirable because the anomalous growth of crystal grains occur.

The average (weight average) particle size of the Li—Mn ferrite carrier, which is calculated from the particle size distribution obtained by a vibration sieve method (JIS H 2601), is preferably 10 to 150 μm, more preferably 30 to 100 μm. The carrier is likely to adhere to the photoconductive surface when the average particle size is less than 10 μm, and the reproduced images are coarse in quality when larger than 150 μm.

The bulk density of the Li—Mn ferrite carrier is 1.4 to 3.3 $g/cm^3$, preferably 2.0 to 2.8 $g/cm^3$. When the bulk density is larger than 3.3 $g/cm^3$, resin flakes removed from the toner by the collision with the carrier adhere to the carrier, this resulting in the change of the specific volume resistivity of the carrier. The mechanical strength of the carrier is low when the bulk density is smaller than 1.4 $g/cm^3$, and the durability of the carrier may be deteriorated. In the present invention, the bulk density was measured by weighing the carrier in a container having a predetermined volume.

The carrier should be moderately flowable to ensure a uniform mixing with the toner. The fluidity index of the Li—Mn ferrite carrier is preferably 5 to 120 s/50 g, preferably 22 to 60 s/50 g. When the fluidity index is higher than 120 s/50 g, the developer is less flowable and the toner cannot be readily mixed with the carrier to make it difficult to maintain the toner concentration in the developer constant. When the fluidity index is less than 5 s/50 g, the carrier is so easily flowable that the carrier is scattered in or outside a developing machine and is difficult to be handled. Also, the carrier tends to fail in providing the toner with a sufficient triboelectric charge. The fluidity index was measured according to JIS Z2502 "Measurement of Fluidity of Metal Powder," in which the period of time (second) required for 50 g of the carrier to flow through a funnel having 2.63 mm orifice was measured.

The saturation magnetization of the Li—Mn ferrite carrier is preferably 40 emu/g or more, and usually 90 emu/g or less. When the saturation magnetization is less than 40 emu/g, the carrier is weakly attracted on a developing roll to likely cause the carrier adhesion, this resulting in white spots on the reproduced images. The magnetization measured in a magnetic field of 1000 Oe ($\sigma_{1000}$) is preferred to be 40 to 80 emu/g, more preferably 50 to 75 emu/g. When $\sigma_{1000}$ is less than 40 emu/g, the carrier is weakly attracted on a developing roll to likely cause the carrier adhesion, this resulting in white spots on the reproduced images. When $\sigma_{1000}$ is higher than 80 emu/g, the magnetic brush is so high and rigid that the photosensitive surface is strongly rubbed by the magnetic brush to reproduce images with brush marks or poor in halftone reproduction. The magnetization was measured by using a vibrating magnetometer (VSM-3 manufactured by Toei Kogyo K.K.).

The specific volume resistivity of the Li—Mn ferrite carrier is preferably $10^5$ to $10^{13}$ Ω·cm, more preferably $10^6$ to 10 Ω.cm when measured in an electric field of D.C. 200 V/cm. When the specific volume resistivity is lower than $10^5$ Ω·cm, the carrier is likely to fall off from the magnetic brush to cause the carrier adhesion, and an uneven solid black images are reproduced due to a strong edge effect when exceeding $10^{13}$ Ω.cm.

When a carrier having a specific volume resistivity sensitive to the intensity of the electric field is intended, the specific volume resistivity ($R_1$) measured in an electric field of D.C. 200 V/cm is preferably $10^5$ to $10^{13}$ Ω·cm, more preferably $10^6$ to $10^{13}$ Ω·cm. Also, the volume resistivity measured ($R_2$) in an electric field of D.C. 10 kV/cm is preferred to be regulated so that the ratio $R_1/R_2$ is 10 or more, preferably 19 to $1.5\times10^5$. The carrier, particularly the carrier for use in reversal developing method, is desirable to have a high specific volume resistivity enough to maintain a sufficient charge in the region other than the developing zone, and a low specific volume resistivity in the developing zone to ensure the application of a high bias voltage therein. To meet the requirement, it is necessary that $R_1$ is higher than $R_2$. When $R_1/R_2$ is lower than 10, the above requirement cannot be satisfied. Each specific volume resistivity may be controlled to a desired level, as will be described below, by suitably selecting the sintering conditions or heat-treating conditions, or by coating an entire part or a part of the surface of the carrier with a resin. The specific volume resistivity was determined from electric resistance measured on the carrier charged into (about 2 mm height) a insulated dial-gauge type Teflon (trade name) cylinder having an inner diameter of 3.05 mm and exposed to an electric field of D.C. 200 V/cm or D.C. 10 kV/cm under a load of about 0.1–0.2 kgf, by using an insulation resistance tester (4329A type tester manufactured by Yokogawa-Hewlett-Packard, Ltd.).

The coercive force of the Li—Mn ferrite carrier of the present invention is preferably 50 Oe or less. When the coercive force is larger than 50 Oe, the ferrite carrier acquires a permanent magnetic character which strongly attains the carrier on the surface of a developing roll to deteriorate the fluidity of the toner. Therefore, the latent image is unevenly developed to produce images of poor quality.

The Li—Mn ferrite carrier of the present invention may be produced as follows. Predetermined amounts of the oxides ($Li_2O$, MnO and $Fe_2O_3$) are mechanically mixed together with or without the sintering aid. The resultant mixture is calcined at 800° to 1000° C. for 1 to 5 hours in an atmosphere such as air, and then, pulverized to powder having a particle size of several μm or less. The powder is, after added with a binding agent, if necessary, sprayed to a heated atmosphere (about 100° to 150° C.) and dried there to obtain granules. The spherical granules thus obtained are then sintered at 1100° to 1300° C. for 2 to 3 hours in an atmosphere such as air. The sintered product is disintegrated and classified, after optionally heat-treatment at 700° to 900° C. for 2 to 3 hours in an inert gas such as $N_2$, Ne, Ar, etc. with or without about 10 volume % or less of oxygen, to obtain the Li—Mn ferrite carrier of the present invention.

The specific volume resistivity ($R_1$ and $R_2$) is controlled by suitably selecting the sintering conditions and heat treatment conditions. Generally, $R_1$ and $R_2$ are influenced by a reductive atmosphere such as nitrogen gas, hydrogen gas, etc. during heating, temperature, heating time, etc., and are decreased along with the progress of the reduction. Also, $R_1$ and $R_2$ decrease with decreasing oxygen partial pressure in the atmosphere, with increasing temperature of sintering and heat treatment, and with increasing period of time of sintering and heat treatment. When the sintering is carried out in nitrogen gas containing 0 to 15 volume % of oxygen, or when the sintering is carried out in air and then the heat treatment is carried out in nitrogen gas containing 0 to 10 volume % of oxygen, each specific volume resistivity ($R_1$ and $R_2$) is easy to be controlled within the range specified above.

The specific volume resistivity ($R_1$ and $R_2$) is also controlled by coating an entire part or a part of the carrier surface with a resin. Suitable materials for the resin layers include homopolymers or copolymers of styrene compounds such as p-chlorostyrene, methylstyrene, etc.; vinyl halides such as vinyl chloride, vinyl bromide, vinyl fluoride, etc.; vinyl esters such as vinyl acetate, vinyl propionate, vinyl benzoate, etc.; aliphatic monocarboxylates such as methyl acrylate, ethyl acrylate, butyl acrylate, isobutyl acrylate, dodecyl acrylate, n-octyl acrylate, 3-chloroethyl acrylate, phenyl acrylate, methyl α-chloroacrylate, butyl methacrylate, etc.; acrylonitrile, methacrylonitrile, acrylamide; vinyl ethers such as vinyl methyl ether, vinyl isobutyl ether, vinyl ethyl ether, etc.; vinyl ketones such as vinyl ethyl ketone vinyl hexyl ketone, methyl isopropenyl ketone, etc.; and other resins such as epoxy resins, silicone resins, rosin-modified phenol-formaldehyde resins, cellulose resins, polyether resins, polyvinyl butyral resins, polyester resins, styrene-butadiene resins, polyurethane resins, polycarbonate resins, fluorocarbon resins such as tetrafluoroethylene, etc. These resin materials may be used alone or in combination. Among them, styrene-acrylic resins, silicone resins, epoxy resins, styrene-butadiene resins, cellulose resins, etc. are particularly preferable.

The resin may be coated on the carrier according to the following method. First, the resin material is dissolved, suspended or emulsified in an adequate solvent such as benzene, toluene, xylene, methyl ethyl ketone, tetrahydrofuran, chloroform, hexane, etc., to produce a resin solution, suspension or emulsion. The resin solution, suspension or emulsion is sprayed onto the surfaces of the carrier particles to form uniform resin layers thereon. To obtain the uniform resin layer, the carrier particles are preferably maintained in a fluidized state desirably by employing a spray dryer or a fluidized bed. In the case of the resin solution, the solution is sprayed at about 200° C. or lower, preferably at about 100°–150° C., to rapidly remove a solvent from the resultant resin layer. In the case of the resin emulsion, the emulsion is sprayed at a temperature ranging from room temperature to 100° C. The amount of the resin to be coated on the carrier is 0.1 to 3 weight %, preferably 0.5 to 2 weight % based on the amount of the Li—Mn ferrite carrier in view of film-forming property and durability of the resin coating.

The resin coating may contain therein and/or on the surface thereof additives which may include an electroconductive material such as carbon black, metals, metal oxides, etc., an inorganic material such as silica, alumina, titanium oxide, talc, etc., and a charge controlling agent such as nigrosine dye, metal-containing azo dye, triphenylmethane dye, metal complex of alkylsalicylic acid, etc.

B. Toner

The Li-Mn ferrite carrier is mechanically mixed with a toner to prepare a magnetic developer. The toner may be produced by a known method such as a pulverizing method, an emulsion polymerization method, a suspension polymerization method, a dispersion polymerization method, etc., and comprises an essential component such as a binder resin and a colorant, and an optional component such as a charge controlling agent, a magnetic powder, a releasing agent, a flowability improver, etc. The toner concentration in the developer is preferably 2 to 20 weight % for a non-magnetic toner and 10 to 90 weight % for a magnetic toner, each based on the total amount of the developer.

In the present invention, the toner known in the art may be used. However, the negatively chargeable toner and the positively chargeable toner, both mentioned below, are more effective.

B-1 Negatively Chargeable Toner

The negatively chargeable toner is used in a normal developing method in which a positively charged selenium photoconductor is used, or in a reversal developing method in which a negatively charged zinc oxide photoconductor or organic photoconductor is used. The recent increase of the copy speed in copying machines employing electrophotography and the printing speed in laser beam printers has come to require the toner to be easily and rapidly fixed on a recording sheet. In view of energy-saving, a heat roller fixing device is used because of its low power consumption. For more effective energy-saving, the toner should be fixed at a temperature as low as possible. Since a polyester resin (linear or non-linear polyester) has a low softening point, a polyester resin preferably having a number average molecular weight (Mn) of 1500 to 2500 and a weight average molecular weight (Mw) of $1\times10^4$ to $5\times10^5$ is used as the binder resin for the negatively chargeable toner. The non-linear polyester resin is more preferable because it fixes more rapidly. Other binder resins usable as the binder resin for the negatively chargeable toner may include styrene-based resin, epoxy resin, etc.

The non-linear polyester resin is produced by polycondensing at least one polyol and at least one polycarboxylic acid (polybasic carboxylic acid). At least one of the polyols and polycarboxylic acids must be trivalent or higher-valent to form a non-linear polymer chain. The term "non-linear" used herein means that the polymer chain is branched due to the presence, in the polymer chain, of a trivalent unit and/or higher-valent unit (polyol unit and/or polycarboxylic acid unit). The divalent polyol may include bisphenol A, ethylene glycol, diethylene glycol, triethylene glycol, 1,2-propylene glycol, 1,4-butanediol, 1,5-pentanediol, 1,6-hexanediol, etc., and the trivalent and higher-valent polyol may include sorbitol, 1,4-sorbitan, pentaerythritol, glycerol, trimethylolethane, trimethylolpropane, etc. The divalent polycarboxylic acid may include terephthalic acid, isophthalic acid, maleic acid, itaconic acid, succinic acid, adipic acid, sebacic acid, malonic acid and an acid anhydride thereof, and the trivalent and higher-valent polycarboxylic acid may include trimellitic acid, trimesic acid and an acid anhydride thereof. An aromatic bisphenol A-type polyester resin is particularly preferable.

The material for the colorant may include carbon black, aniline blue, Chalco oil blue, chrome yellow, ultramaric blue, Du Pont oil red, quinoline yellow, methylene blue chloride, phthalocyanine blue, malachite green oxalate, lamp black, rose bengal, disazo yellow, quinacridone magenta, etc. The colorant is contained 3 to 15 weight % based on the total weight of the negatively chargeable toner.

As the negative charge controlling agent, exemplified are a metal-containing azo dye, a copper phthalocyanine dye, an alkyl derived complex of salicylic acid, etc. The negative charge controlling agent may be contained 0.2 to 10 weight % based on the total weight of the toner.

The magnetic powder may be an alloy or compound containing a ferromagnetic element such as iron, cobalt, nickel, etc., or may be an alloy which acquires ferromagnetism by some treatment, for example, heat treatment. The typical examples for the magnetic powder are magnetite, cobalt-added magnetite, spinel-type ferrite, magnetoplumbite-type ferrite. The magnetic powder has an average particle size of 0.1 to 1 $\mu$m so as to be uniformly dispersed in the binder resin, and may be contained 30 to 60 weight % based on the total weight of the toner.

The releasing agent may be used for preventing the off-set which is a phenomenon of image contamination caused by transfer of the toner adhered on the heat roll surface to a recording paper. The releasing agent may be polyolefin, metal salt of fatty acid, ester of fatty acid, partially saponified ester of fatty acid, higher fatty acid, higher alcohol, paraffin wax, ester of polyhydric alcohol, etc. In particular, a low molecular weight polypropylene having a weight average molecular weight of 50,000 or lower or a polyethylene wax is effective. The releasing agent may be contained 0.5 to 30 weight %, preferably 1 to 10 weight % based on the total weight of the toner.

The flowability improver is added to the toner surface and is a fine powder of silica, alumina, titanium oxide, barium titanate, magnesium titanate, calcium titanate, strontium titanate, zinc oxide, silica sand, clay, mica, diatomaceous earth, etc. The addition amount is 0.05 to 5 weight % based on the total weight of the toner.

B-2 Positively Chargeable Toner

The positively chargeable toner is used in a reversal developing method in which a positively charged selenium photoconductor is used, or in a normal developing method in which a negatively charged zinc oxide photoconductor or organic photoconductor is used. Since polyester resins are strongly negative-chargeable and not suitable for the positively chargeable toner, a styrene-acrylic copolymer resin preferably having a number average molecular weight (Mn) of $4\times10^3$ to $2\times10^4$ and a weight average molecular weight (Mw) of $4\times10^4$ to $1\times10^6$ is used as the binder resin for the positively chargeable toner. Other resins usable as the binder resin may include epoxy resin, acrylic resin, etc.

The styrene-acrylic copolymer resin is produced by copolymerising a styrene monomer and an acrylic monomer. The styrene monomer may include styrene, o-methylstyrene, m-methylstyrene, p-methylstyrene, α-methylstyrene, p-ethylstyrene, 2,4-dimethylstyrene, p-n-butylstyrene, p-t-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene, 3,4-dichlorostyrene, etc. These may be used alone or in combination of two or more. The acrylic monomer may include α-methylene aliphatic mono carboxylic acid, ester thereof and derivative thereof such as acrylic acid, methyl acrylate, ethyl acrylate, n-butyl acrylate, isobutyl acrylate, propyl acrylate, n-octyl acrylate, dodecyl acrylate, lauryl acrylate, 2-ethylhexyl acrylate, stearyl acrylate, 2-chloroethyl acrylate, phenyl acrylate, methyl α-chloroacrylate, methacrylic acid, methyl methacrylate, ethyl methacrylate, propyl methacrylate, n-butyl methacrylate, isobutyl methacrylate, n-octyl methacrylate, dodecyl methacrylate, lauryl methacrylate, 2-ethylhexyl methacrylate, stearyl methacrylate, phenyl methacrylate, dimethylaminoethyl methacrylate, diethylaminoethyl methacrylate, etc. These acrylic monomers may be used alone or in combination of two or more. The styrene-acrylic copolymer may be produced by a known solution polymerization, suspension polymerization, emulsion polymerization, etc.

The same colorant as those for the negative chargeable toner may be used in an amount of 1 to 20 weight % based on the total weight of the toner.

As the positive charge controlling agent, a nigrosine dye is commonly used, and also usable are a quaternary ammonium salt, a triphenylmethane dye, a piperadine-type polymer, etc. The addition amount is 0.2 to 10 weight % based on the total weight of the toner.

The same magnetic powder as those for the negative chargeable toner may be used in an amount of 30 to 60 weight % based on the total weight of the toner. The magnetic powder has an average particle size of 0.1 to 1 μm so as to be uniformly dispersed in the binder resin.

As the releasing agent, the low molecular weight polypropylene and polyethylene wax may be preferably used in an amount of 0.5 to 30 weight %, preferably 1to 10 weight % based on the total weight of the toner.

The same flowability improver as those for the negative chargeable toner may be used in an amount of 0.05 to 3 weight % based on the total weight of the toner.

The toner mentioned above is preferred to have the following properties. When the average (volume average) particle size is too small, background fogging and toner scattering occur, and rough images are reproduced when too large. Therefore, the average particle size is preferably 5 to 15 μm for both the positive and negative chargeable toners. The specific volume resistivity is preferably $10^{14}$ Ω·cm or more, for both toners, to maintain the sufficient transferring of the toner to the photoconductive surface. When the charged amount in terms of absolute value is too small, the background fogging frequently occur, and the image density is reduced when too large. Therefore, the triboelectrically charged amount is preferably −5 to −60 μC/g, more preferably −10 to −40 μC/g for the negative chargeable toner, and preferably +5 to +40 μC/g, more preferably +5 to +30 μC/g for the positively chargeable toner.

The specific volume resistivity of the toner was determined in the same manner as in the carrier except for changing the electric field to D.C. 4 kV/cm. The triboelectric charge was determined as follows. A magnetic developer (toner content of 5 weight %) consisting of a toner being measured and a ferrite carrier (KBN-100 manufactured by Hitachi Metals, Ltd.) was mixed well, and blown at a blowing pressure of 1.0 kgf/cm$^2$. The triboelectric charge of the toner thus treated was measured by using an electric charge measuring apparatus (TB-200 manufactured by Toshiba Chemical Co. Ltd.). The volume average particle size of the toner was measured by a particle size analyzer (Coulter Counter Model TA-II manufactured by Coulter Electronics Co.).

Each toner may be produced as follows. The colorant and the charge controlling agent, if used, are pre-mixed in a blender such as a ball mill, super mixer, etc., and then the binder resin and optionally the magnetic powder and the releasing agent are added to the mixture and mixed together. The resulting mixture is melt-kneaded in a kneader such as a twin-screw kneader, cooled, and coarsely pulverized by a mechanical pulverizer and finely pulverized by an air pulverizer. The fine powder is then classified by an air classifier to obtain the toner having the average particle size of 5 to 15 μm.

C. Developing Method

FIG. 1 is a schematic sectional view showing a developing apparatus embodying the present invention. A developer container 1 stores a magnetic developer 2 and partially receives at the lower side portion a developing roll 6 which comprises a hollow and rotatable cylindrical sleeve 5 made of a non-magnetic metal (for example, SUS 304) and a cylindrical permanent magnet 4 having a plurality of magnetic poles on the surface thereof. The permanent magnet 4 may be rotatable or stationary, and is coaxially mounted in the sleeve 5. The permanent magnet 4 may comprise a plurality of block magnets (anisotropic ferrite magnet) fixed around a shaft, or a plurality of block magnets (plastic magnet) laminated together.

A photosensitive drum 7 is rotatable in the direction indicated by the arrow and opposed to the developing roll 6 through a developing gap g. The thickness of a magnetic developer layer on the sleeve 5 is regulated by a doctor blade 8 positioned at an end of the developer container 1 and opposed to the developing roll 6 through a doctor gap t. Generally, the developing gap g is slightly larger than the doctor gap t. The developing gap g is preferably 0.3 to 2 mm, and the doctor gap t is preferably 0.1 to 0.5 mm. The different between g and t (g−t) is preferably 0.05 to 0.2 mm. By suitably selecting t and g−t, a jumping development can be conducted.

An alternating current supply 9 and a direct current supply 10 are connected between the photoconductive drum 7 and the sleeve 5 to apply a D.C./A.C. superimposed bias to the developing zone. The peak-to-peak voltage ($V_{pp}$) of the A.C. bias voltage is 500 V to 2.5 kV. If less than 500 V, the image density is low and the carrier adhesion occurs. If exceeding 2.5 kV, the background fogging frequently occurs. The frequency of the A.C. bias is preferably 100 Hz to 10 kHz in view of preventing the carrier adhesion and the background fogging. The D.C. bias voltage, the same polarity as the charge of latent image, is preferably 50 to 200 V for the normal development and 0.6 to 0.9 times the surface potential of the photosensitive surface when the reversal development is conducted.

A mixing roller 11 is mounted in the developer container 1 so that a toner 14 supplied from a toner storage 12 through a supplying roller 13 is uniformly mixed with the magnetic developer 2 in the developer container 1.

As the sleeve 5 rotates in the direction indicated by the arrow while keeping the permanent magnet member 4 stationary, the magnetic developer 2 is magnetically attracted onto the sleeve 5 and transported to the developing zone. In the developing zone, the toner in the magnetic developer 2 is attracted to the latent image on the photosensitive drum 7 by the force received from the electric field generated by the latent image and bias voltage overcoming the attractive force from the permanent magnet member 4 to the surface of the sleeve 5. The latent image is developed in this manner.

The magnetic developer usable in the above developing method may be a one-component developer containing only a magnetic toner or may be a two-component developer containing a magnetic carrier and a toner. However, the Li—Mn ferrite carrier, the toner and the developer mentioned above are preferably used. In this case, the Li—Mn ferrite carrier is preferred to have a specific volume resistivity of $10^5$ to $10^{13}$ Ω·cm at 200 V/cm, and a specific surface area of 0.03 to 0.5 $m^2/g$, preferably 0.1 to 0.3 $m^2/g$ when measured by BET adsorption method.

The present invention will be further described while referring to the following Examples which should be considered to illustrate various preferred embodiments of the present invention.

EXAMPLE 1

A starting material containing $Li_2O$, MnO, $Fe_2O_3$ and the sintering aid in respective amounts shown in Table 1 was mixed in a ball mill. The mixture was calcined at 900° C. for 2 hours, and pulverized by an attritor to a powder having an average particle size about 0.7 μm. After adding polyvinyl alcohol in an amount of 0.5 to 1.0 weight %, the pulverized powder was granulated by spray-drying. After sintered in an aluminum vessel at 1250° C., the granule was disintegrated and classified to obtain a ferrite carrier having an average particle size about 40 μm.

The toner was produced as follows. The following starting materials (part by weight):

binder resin: bisphenol A-type polyester (Mw=19,600, Mn=2,000,) 87 parts, colorant: carbon black (#50, manufactured by Mitsubishi Chemicals Corporation) 10 parts, releasing agent: polypropylene (TP32, manufactured by Sanyo Chemical Industries, Ltd.) 2 parts, and charge controlling agent: (Kayacharge T-2N, manufactured by Nippon Kayaku Co., Ltd.) 1 part were dry blended. The mixture was melt-kneaded in a twin-screw kneader at 150° C., cooled and coarsely pulverized by a mechanical pulverizer until the pulverized powder passed through 1 mm mesh. The powder was then finely pulverized by an air pulverizer and jet mill, followed by the classification by an air classifier (100MZR manufactured by Arpine Co.) to obtain a powder having a volume average particle size about 10 μm. The 100 parts by weight of the powder thus obtained was added with 0.5 part by weight of a hydrophobic silica (flowability improver, Aerosil R972 manufactured by Nippon Aerosil Co.) to obtain a negatively chargeable toner. The triboelectric charge and the specific volume resistivity of the toner were −27.8 μC/g and $10^{14}$ Ω·cm, respectively.

A two-component developer having a toner concentration of 5 weight % was prepared by mixing the toner with each ferrite carrier. By using the two-component developer, the image forming tests were conducted under the following conditions.

Photosensitive drum: organic photoconductor surface potential −650 V peripheral speed:60 mm/s Developing roll:

magnet roll: asymmetric 4-poles surface magnetic flux density developing pole 800 G other poles 700 G sleeve: SUS304 20 mm outer diameter rotation speed: 150 rpm Developing gap: 0.4 mm Doctor gap: 0.3 mm Bias voltage: −550 V (D.C.)

Transfer: corona transfer

Fixing: oilless heat roll (180° C., 1 kgf/cm line pressure)

Atmosphere: 20° C., 60% RH.

The results of the test are shown in Table 1. In Table 1, the image density is a reflectance optical density measured by a Macbeth densitometer. The value of the image density is preferred to be 1.30 or more. The background fogging is a difference in density of non-printed area of paper between before and after printing, and was measured by a colorimetric color-difference meter manufactured by Nippon Denshoku Kogyo K.K. The value for the background fogging should be as low as possible, preferably 0.10 or less.

The shape factor of the carrier particle was determined as follows. The projected images of the carriers under a optical microscope was processed by an image processing apparatus (LUZEX II mannufactured by Nireco Co.) to calculate $L^2/A\times\pi/4$ wherein L is a peripheral length and A is an area of each projected image. The calculation was repeated on 1000 projected images, and the value most frequently occurred was determined as the shape factor of the carriers. The shape factor of the carriers having smooth spherical surface is near 1.

TABLE 1

| | Chemical Composition (mol %) | | | Sintering Aid | |
|---|---|---|---|---|---|
| No. | $Li_2O$ | MnO | $Fe_2O_3$ | Kind | Amount (wt. %) |
| 1 | 9 | 18 | 73 | CaO | 0.1 |
| 2 | 9 | 18 | 73 | CaO | 0.3 |

TABLE 1-continued

| | | | | | |
|---|---|---|---|---|---|
| 3 | 9 | 18 | 73 | CaO | 0.7 |
| 4 | 9 | 18 | 73 | CaO | 1.0 |
| 5* | 9 | 18 | 73 | CaO | 1.3 |
| 6 | 9 | 18 | 73 | $Na_2O$ | 0.5 |
| 7 | 9 | 18 | 73 | $SiO_2$ | 0.5 |
| 8 | 9 | 18 | 73 | $Al_2O_3$ | 0.5 |
| 9 | 9 | 18 | 73 | $V_2O_5$ | 0.5 |
| 10 | 9 | 18 | 73 | $CaO + SiO_2$ | 0.5 |
| 11 | 9 | 18 | 73 | $Na_2O + Al_2O_3$ | 0.5 |
| 12 | 6 | 30 | 64 | $Al_2O_3$ | 0.5 |
| 13 | 6 | 30 | 64 | $SiO_2$ | 0.5 |
| 14 | 6 | 30 | 64 | CaO | 0.5 |

| | Carrier | | | Image Quality | | |
|---|---|---|---|---|---|---|
| No. | Specific Volume Resistivity (at 200 V/cm, Ω · cm) | $\sigma_{1000}$ (emu/g) | Shape Factor | Density | Fogging | Carrier Adhesion |
| 1 | $1 \times 10^8$ | 57 | 1.15 | 1.35 | 0.05 | none |
| 2 | $2 \times 10^8$ | 59 | 1.12 | 1.38 | 0.07 | none |
| 3 | $2 \times 10^8$ | 61 | 1.10 | 1.39 | 0.03 | none |
| 4 | $5 \times 10^8$ | 60 | 1.08 | 1.41 | 0.05 | none |
| 5* | $5 \times 10^9$ | 55 | 1.07 | 1.15 | 0.27 | none |
| 6 | $2 \times 10^8$ | 57 | 1.10 | 1.38 | 0.06 | none |
| 7 | $5 \times 10^8$ | 59 | 1.08 | 1.41 | 0.10 | none |
| 8 | $7 \times 10^8$ | 61 | 1.12 | 1.42 | 0.10 | none |
| 9 | $8 \times 10^8$ | 62 | 1.05 | 1.40 | 0.08 | none |
| 10 | $4 \times 10^8$ | 60 | 1.08 | 1.38 | 0.05 | none |
| 11 | $2 \times 10^8$ | 61 | 1.05 | 1.35 | 0.03 | none |
| 12 | $2 \times 10^8$ | 50 | 1.10 | 1.39 | 0.05 | none |
| 13 | $5 \times 10^8$ | 49 | 1.12 | 1.39 | 0.04 | none |
| 14 | $7 \times 10^7$ | 51 | 1.15 | 1.41 | 0.07 | none |

Note: *) Comparison

As seen from Table 1, although the carrier of No. 5 had a smooth surface and caused no carrier adhesion, low in the image density and caused the background fogging because contained CaO in an amount exceeding the range of the present invention. On the other hand, since the carriers of Nos. 1 to 4 and 6 to 14 had a smooth surface (shape factor was less than 1.15) and a low specific volume resistivity, images of high quality free from the background fogging and carrier adhesion were reproduced.

EXAMPLE 2

A starting material containing 10 mol % of $Li_2O$, 20 mol % of MnO and 70 mol % of $Fe_2O_3$ was dry-pulverized and mixed in a ball mill. The mixture was calcined at 900° C. for 2 hours, and pulverized by an attritor to a powder having an average particle size about 0.7 μm. After adding polyvinyl alcohol (binding agent) in an amount of 0.5 to 1.0 weight %, the pulverized powder was granulated by spray-drying. After sintered in an aluminum vessel at 1280° C. in air, the granule was heat-treated at 900° C. for 2 hours in nitrogen atmosphere. The sintered product was disintegrated and classified to obtain a ferrite carrier having an average particle size about 40 μm.

The ferrite carrier thus produced had a chemical composition of 10.5 mol % of $Li_2O$, 19.8 mol % of MnO and 69.7 mol % of $Fe_2O_3$. The bulk density, fluidity index and $\sigma_{1000}$ of the carrier were 2.2 g/cm$^3$, 35 s/50 g and 60 emu/g, respectively.

The toner was produced as follows. The starting mixture was prepared by pre-mixing colorant: carbon black (#MA-100, manufactured by Mitsubishi Chemical Corporation) 10 parts, and charge controlling agent: (Kayacharge T-2N, manufactured by Nippon Kayaku Co., Ltd.) 1 part in a ball mill, and further mixing after adding binder resin: bisphenol A-type polyester 87 parts, and releasing agent: polypropylene (TP32, manufactured by Sanyo Chemical Industries, Ltd.) 2 parts.

The mixture was subjected to the same procedures as in Example 1 to obtain a non-magnetic toner having an average particle size of about 10 μm. The specific volume resistivity and the triboelectric charge of the toner were $1.5\times10^{14}$ Ω·cm and −21 μC/g, respectively.

A magnetic toner was prepared by mixing 97 parts by weight of the carrier and 3 parts by weight of the toner. By using the magnetic developer, the image forming tests were conducted under the following conditions.

Reversal Development

Photosensitive drum: organic photoconductor (30 mm diameter) surface potential −650 V peripheral speed:60 mm/s Developing roll:

magnet roll: asymmetric 4-poles (stationary) surface magnetic flux density developing pole 800 G other poles 700 G sleeve: SUS304 20 mm outer diameter rotation speed: 150 rpm Developing gap: 0.4 mm Doctor gap: 0.3 mm Bias voltage: −500 V (D.C.)

Transfer: corona transfer

Fixing: heat roll (180° C., 1 kgf/cm line pressure)

Atmosphere: 20° C., 60% R.H.

The results of the test are shown in Table 2. As seen from the results, the initial properties (image density, background fogging and carrier adhesion) were little changed after 50,000 papers printing operation.

EXAMPLE 3

In the same manner as in Example 2 except for changing the sintering temperature to 1250° C. and omitting the heat treatment, a ferrite carrier having an average particle size of 40 μm was produced.

The ferrite carrier thus produced had a chemical composition of 9.8 mol % of $Li_2O$, 21.2 mol % of MnO and 69 mol % of $Fe_2O_3$. The bulk density, fluidity index and $\sigma_{1000}$ of the carrier were 2.5 g/cm$^3$, 28 s/50 g and 65 emu/g, respectively.

A magnetic toner was prepared by mixing 97 parts by weight of the carrier and 3 parts by weight of the toner produced in Example 2. By using the magnetic developer, the image forming tests were conducted under the same conditions as in Example 2. The results of the test are shown in Table 2. As seen from the results, the initial properties (image density, background fogging and carrier adhesion) were little changed after 50,000 papers printing operation.

COMPARATIVE EXAMPLE 1

In the same manner as in Example 2 except for omitting the heat treatment, a ferrite carrier having an average particle size of 40 μm was produced.

The ferrite carrier thus produced had a chemical composition of 10.1 mol % of $Li_2O$, 19.9 mol % of MnO and 70 mol % of $Fe_2O_3$. The bulk density, fluidity index and $\sigma_{1000}$ of the carrier were 2.4 g/cm$^3$, 32 s/50 g and 62 emu/g, respectively.

A magnetic toner was prepared by mixing 97 parts by weight of the carrier and 3 parts by weight of the toner produced in Example 2. By using the magnetic developer, the image forming tests were conducted under the same conditions as in Example 2. The results of the test are shown in Table 2. As seen from the results, it would appear that the initial quality of the reproduced image were poor in image density, background fogging and carrier adhesion, because the ratio of $R_1/R_2$ was less than 10. Also, the image quality was further deteriorated after 50,000 papers printing operation.

EXAMPLE 4

In the same manner as in Example 2 except for changing the proportion of the starting material to 5 mol % of $Li_2O$, 25 mol % of MnO and 70 mol % of $Fe_2O3$, a ferrite carrier having an average particle size of 40 μm was produced.

The ferrite carrier thus produced had a chemical composition of 5.1 mol % of $Li_2O$, 25.2 mol % of MnO and 69.7 mol % of $Fe_2O_3$. The bulk density, fluidity index and $\sigma_{1000}$ of the carrier were 2.5 g/cm$^3$, 27 s/50 g and 55 emu/g, respectively.

A magnetic toner was prepared by mixing 97 parts by weight of the carrier and 3 parts by weight of the toner produced in Example 2. By using the magnetic developer, the image forming tests were conducted under the same conditions as in Example 2. The results of the test are shown in Table 2. As seen from the results, the initial properties (image density, background fogging and carrier adhesion) were little changed after 50,000 papers printing operation.

EXAMPLE 5

In the same manner as in Example 2 except for changing the proportion of the starting material to 5 mol % of $Li_2O$, 20 mol % of MnO and 75 mol % of $Fe_2O_3$, a ferrite carrier having an average particle size of 50 μm was produced.

The ferrite carrier thus produced had a chemical composition of 4.9 mol % of $Li_2O$, 20.2 mol % of MnO and 74.9 mol % of $Fe_2O_3$. The bulk density, fluidity index and $\sigma_{1000}$ of the carrier were 2.6 g/cm$^3$, 29 s/50 g and 63 emu/g, respectively.

A magnetic toner was prepared by mixing 90 parts by weight of the carrier and 10 parts by weight of the toner produced in Example 2. By using the magnetic developer, the image forming tests were conducted under the same conditions as in Example 2. The results of the test are shown in Table 2. As seen from the results, the initial properties (image density, background fogging and carrier adhesion) were little changed after 50,000 papers printing operation.

EXAMPLE 6

In the same manner as in Example 2 except for changing the proportion of the starting material to 11.6 mol % of $Li_2O$, 8 mol % of MnO and 80.4 mol % of $Fe_2O_3$ and adding 0.7 weight % of $V_2O_5$ based on $Li_2O$+MnO+$Fe_2O_3$, a ferrite carrier having an average particle size of 50 μm was produced.

The ferrite carrier thus produced had a chemical composition of 11.0 mol % of $Li_2O$, 8.1 mol % of MnO and 80.9 mol % of $Fe_2O_3$. The content of $V_2O_5$ was 0.4 weight % based on $Li_2O$+MnO+$Fe_2O_3$.

The carrier thus obtained was then coated with a resin as follows. 500 parts by weight of the carrier in fluidized bed were kept at 80° C., and a mixture of 10 parts by weight of silicone resin (SR2406 manufactured by Toray Dow Corning Co.) and 10 parts by weight of toluene was spray-coated on the carrier. The carrier was then subjected to a thermosetting treatment at 150° C. for 2 hours to produce a carrier coated with a silicone resin. The bulk density, fluidity index and $\sigma_{1000}$ of the resin-coated carrier were 2.5 g/cm$^3$, 28 s/50 g and 58 emu/g, respectively.

A magnetic toner was prepared by mixing 90 parts by weight of the carrier and 10 parts by weight of the toner produced in Example 2. By using the magnetic developer, the image forming tests were conducted under the same conditions as in Example 2. The results of the test are shown in Table 2. As seen from the results, the initial properties (image density, background fogging and carrier adhesion) were little changed after 50,000 papers printing operation.

TABLE 2

| | $R_1$* (Ω · cm) | $R_2$* (Ω · cm) | $R_1/R_2$ | $\sigma_{1000}$ (emu/g) |
|---|---|---|---|---|
| Examples | | | | |
| 2 | $8.6 \times 10^8$ | $7.9 \times 10^7$ | 10.89 | 60 |
| 3 | $1.6 \times 10^7$ | $6.5 \times 10^5$ | 24.62 | 65 |
| Comparative Example | | | | |
| 1 | $1.1 \times 10^9$ | $7.4 \times 10^8$ | 1.49 | 62 |

TABLE 2-continued

| | | | | |
|---|---|---|---|---|
| Examples | | | | |
| 4 | $5.5 \times 10^8$ | $2.8 \times 10^7$ | 19.64 | 55 |
| 5 | $1.2 \times 10^8$ | $2.6 \times 10^6$ | 46.15 | 63 |
| 6 | $9.3 \times 10^{12}$ | $8.7 \times 10^7$ | $1.1 \times 10^5$ | 58 |

Note:
$R_1$ is a specific volume resistivity measured in electric field of D.C. 200 V/cm.
$R_2$ is a specific volume resistivity measured in electric field of D.C. 10 kV/cm.

| | Initial Stage | | | After 5000 Printings | | |
|---|---|---|---|---|---|---|
| | Image Density | Background Fogging | Carrier Adhesion | Image Density | Background Fogging | Carrier Adhesion |
| Examples | | | | | | |
| 2 | 1.39 | 0.07 | none | 1.41 | 0.08 | none |
| 3 | 1.40 | 0.08 | none | 1.35 | 0.08 | none |
| Comparative Example | | | | | | |
| 1 | 1.20 | 0.15 | slight | 1.12 | 0.38 | heavy |
| Examples | | | | | | |
| 4 | 1.42 | 0.08 | none | 1.40 | 0.09 | none |
| 5 | 1.40 | 0.07 | none | 1.38 | 0.08 | none |
| 6 | 1.35 | 0.05 | none | 1.39 | 0.08 | none |

EXAMPLE 7

In the same manner as in Example 1 except for using a starting material consisting of 9 mol % of $Li_2O$, 18 mol % of MnO and 73 mol % of $Fe_2O_3$ and changing the sintering temperature to 1200° C., a ferrite carrier having an average particle size of 50 μm was produced. The carrier (100 parts by weight) was coated with 0.5 to 3.0 parts by weight of a silicone resin in the same manner as in

EXAMPLE 6.

Negatively chargeable toners (average particle size: 10 μm) having a specific volume resistivity of $10^{14}$ Ω·cm and respective triboelectric charge were produced in the same manner as in Example 1.

A magnetic toner was prepared by mixing 95 parts by weight of the carrier and 5 parts by weight of the toner. By using the magnetic developer, the image forming tests were conducted under the same conditions as in Example 1. The results of the test are shown in Table 3.

TABLE 3

| | Carrier | | Toner |
|---|---|---|---|
| No. | Amount of Resin (weight %) | Specific Volume Resistivity (200 V/cm) (Ω · cm) | Triboelectric Charge (μC/g) |
| 1 | 0.5 | $10^7$ | −20.2 |
| 2 | 1.0 | $10^8$ | −25.4 |
| 3 | 1.5 | $10^{10}$ | −27.8 |
| 4 | 2.0 | $10^{13}$ | −32.0 |
| 5* | 3.0 | $10^{14}$ | −37.2 |

| No. | Image Density | Background Fogging | Carrier Adhesion |
|---|---|---|---|
| 1 | 1.35 | 0.05 | none |
| 2 | 1.38 | 0.04 | none |
| 3 | 1.39 | 0.03 | none |
| 4 | 1.40 | 0.03 | none |
| 5* | 1.25 | 0.15 | heavy |

Note: *) Comparison

As seen from the results, since the carrier of No. 5 had a specific volume resistivity exceeding the range specified in the present invention, the toner was not uniformly charged. This results in the reduced image density and the occurrence of the background fogging and carrier adhesion due to the insufficient bias. On the other hand, the carrier of the present invention (Nos. 1 to 4) provided images of high quality.

EXAMPLE 8

In the same manner as in Example 1 except for using the following starting materials (part by weight):

binder resin: styrene-n-butyl acrylate copolymer (Mw=52,000, Mn=4,200,), 93 parts, colorant (cyan): C.I. pigment blue 15-3, 4 parts, releasing agent: polyethylene wax (200P, manufactured by Mitsui Petrochemical Industries, Ltd.) 1 part, and charge controlling agent: (TP-415, manufactured by Hodogaya Chemical Co. Ltd.) 2 parts, a positively chargeable toner having a specific volume resistivity of $10^{14}$ Ω·cm was produced.

A magnetic toner was prepared by mixing 95 parts by weight of each carrier of Example 7 and 5 parts by weight of the above toner. By using the magnetic developer, the image forming tests were conducted under the same conditions as in Example 1 except for changing the surface potential and the bias voltage to +550 V and +400 V (D.C.), respectively. The results of the test are shown in Table 4.

TABLE 4

| | Carrier | | Toner |
|---|---|---|---|
| No. | Amount of Resin (weight %) | Specific Volume Resistivity (200 V/cm) (Ω · cm) | Triboelectric Charge (μC/g) |
| 1* | 0 | $10^5$ | +4.9 |
| 2 | 0.5 | $10^6$ | +7.9 |
| 3 | 1.0 | $10^8$ | +9.8 |
| 4 | 1.5 | $10^{10}$ | +10.2 |
| 5 | 2.0 | $10^{12}$ | +12.5 |
| 6* | 3.0 | $10^{14}$ | +19.1 |

TABLE 4-continued

| No. | Image Density | Background Fogging | Carrier Adhesion |
|---|---|---|---|
| 1* | 1.38 | 0.17 | heavy |
| 2 | 1.37 | 0.10 | none |
| 3 | 1.39 | 0.07 | none |
| 4 | 1.41 | 0.06 | none |
| 5 | 1.40 | 0.04 | none |
| 6* | 0.96 | 0.08 | heavy |

Note: *) Comparison

As seen from the results, since the carrier No. 1 was low in the triboelectric charge, the background fogging and carrier adhesion heavily occurred. In No. 6, the toner was not uniformly charged, because the carrier had a specific volume resistivity exceeding the range specified in the present invention. This results in the reduced image density and the occurrence of the carrier adhesion. On the other hand, the carrier of the present invention (Nos. 2 to 5) provided images of high quality.

EXAMPLE 9

Each carrier was produced in the same manner as in Example 7. The chemical composition and the properties of the carrier are shown in the Table 5.

TABLE 5

| | Composition (mol %) | | | Specific Volume Resistivity (200 V/cm) | Average Particle | Specific Surface |
|---|---|---|---|---|---|---|
| | $Li_2O$ | MnO | $Fe_2O_3$ | (Ω · cm) | Size (μm) | Area ($m^2$/g) |
| A | 6 | 30 | 64 | $1 \times 10^9$ | 75 | 0.12 |
| B | 9 | 18 | 73 | $3 \times 10^8$ | 50 | 0.17 |
| C | 12 | 8 | 80 | $1 \times 10^8$ | 25 | 0.14 |

A magnetic toner was prepared by mixing 95 parts by weight of each carrier and 5 parts by weight of the toner of Example 1. By using the magnetic developer, the image forming tests were conducted under the same conditions as in Example 1 except for superimposing A.C. bias as shown in Table 6 to the D.C. bias (−550 V). The results are shown in Table 6.

TABLE 6

| | | A.C. Bias | |
|---|---|---|---|
| No. | Carrier | Vpp (kV) | frequency (kHz) |
| Invention | | | |
| 1 | A | 0.8 | 1.0 |
| 2 | B | 0.8 | 1.0 |
| 3 | C | 0.8 | 1.0 |
| Comparison | | | |
| 4 | B | 2.7 | 1.0 |
| 5 | B | 0.45 | 1.0 |
| 6 | B | 0.8 | 12.0 |
| 7 | B | 0.8 | 0.09 |
| Invention | | | |
| 8 | B | 0.5 | 0.1 |
| 9 | B | 1.0 | 2.0 |
| 10 | B | 2.5 | 10.0 |

TABLE 6-continued

| No. | Image Density | Background Fogging | Carrier Adhesion |
|---|---|---|---|
| Invention | | | |
| 1 | 1.42 | 0.05 | none |
| 2 | 1.41 | 0.02 | none |
| 3 | 1.39 | 0.02 | slight |
| Comparison | | | |
| 4 | 1.42 | 0.15 | heavy |
| 5 | 1.20 | 0.02 | slight |
| 6 | 1.30 | 0.17 | heavy |
| 7 | 1.32 | 0.15 | slight |
| Invention | | | |
| 8 | 1.39 | 0.05 | none |
| 9 | 1.41 | 0.05 | none |
| 10 | 1.42 | 0.04 | none |

From comparing No. 2 with No. 4 or No. 5, it would appear that the background fogging and the carrier adhesion become significant when the A.C. bias voltage is too high, and the image density is reduced when too low. Also, from comparing No. 2 with No. 6 or No. 7, it would appear that the background fogging and the carrier adhesion frequently occur when the frequency of the A.C. bias voltage is too high, and the background fogging is significant when too low.

From the results of Nos. 1 to 3 and Nos. 8 to 10, it would appear that the peak-to-peak voltage of 0.5 to 2.5 kV and the frequency of 0.1 to 10 kHz are critical for obtaining images of high quality.

Further, it was confirmed that images of the same quality as in the initial stage of printing operation were obtained in Nos. 1 to 3 and Nos. 8 to 10 even after continuous 5000 printing operation.

What is claimed is:

1. A ferrite carrier comprising 2 to 15 mol % of $Li_2O$, 5 to 30 mol % of MnO and 60 to 90 mol % of $Fe_2O_3$, each molar percentage being based on the total of $Li_2O$, MnO and $Fe_2O_3$, and containing at least one sintering aid selected from the group consisting of CaO, $Na_2O$, $SiO_2$, $V_2O_5$, $Al_2O_3$, $As_2O_3$, $Bi_2O_3$, $Sb_2O_3$ and $B_2O_3$ in an amount of 0.1 to 1.2 weight % based on the total of $Li_2O$, MnO and $Fe_2O_3$, said ferrite carrier having an average particle size of 10 to 150 μm, a magnetization of 40 to 80 emu/g at a magnetic field of 1000 Oe, a specific volume resistivity of $10^6$ to $10^{10}$ Ω·cm when measured at an electric field of 200 V/cm and a specific volume resistivity ratio, $R_1/R_2$, of 10 or more wherein $R_1$ is said specific volume resistivity measured at an electric field of 200 V/cm and $R_2$ is a specific volume resistivity measured at an electric field of 10 kV/cm.

2. The ferrite carrier according to claim 1, wherein said sintering aid is at least one selected from the group consisting of CaO, $Na_2O$, $SiO_2$, $V_2O_5$, and $Al_2O_3$.

3. A ferrite carrier comprising 2 to 15 mol % of $Li_2O$, 5 to 30 mol % of MnO and 60 to 90 mol % of $Fe_2O_3$, each molar percentage being based on the total of $Li_2O$, MnO and $Fe_2O_3$, wherein an average particle size of said carrier is 10 to 150 μm, a magnetization of said carrier measured in a magnetic field of 1000 Oe is 40 to 80 emu/g, a specific volume resistivity ($R_1$) of said carrier measured at an electric field of 200 V/cm is $10^5$ to $10^{13}$ Ω·cm, and a ratio ($R_1/R_2$) of $R_1$ and a specific volume resistivity ($R_2$) of said carrier measured at an electric field of 10 kV/cm is 10 or more.

4. The ferrite carrier according to claim 3, wherein a bulk density of said carrier is 1.4 to 3.3 g/cm$^3$.

5. The ferrite carrier according to claim 3, wherein a fluidity index of said carrier is 5 to 120s/50 g.

6. A two-component developer comprising an Li—Mn ferrite carrier and a toner, wherein;

said Li—Mn ferrite carrier comprises 2 to 15 mol % of $Li_2O$, 5 to 30 mol % of MnO and 60 to 90 mol % of $Fe_2O_3$, each molar percentage being based on the total of $Li_2O$, MnO and $Fe_2O_3$, and has a resin coating layer on a surface thereof, said ferrite carrier having a magnetization of 40 to 80 emu/g at a magnetic field of 1000 Oe, a specific volume resistivity of $10^5$ to $10^{13}$ Ω·cm when measured at an electric field of 200 V/cm and a specific volume resistivity ratio, $R_1/R_2$, of 10 or more wherein $R_1$ is said specific volume resistivity measured at an electric field of 200 V/cm, and $R_2$ is a specific volume resistivity measured at an electric field of 10 kV/cm; and said toner comprises a resin binder and a colorant as the essential component and has an average particle size of 5 to 15 μm and a triboelectric charge of −5 to −60 μC/g or +5 to +40 μC/g.

7. The developer according to claim 6, wherein said toner is a negatively chargeable toner containing a polyester resin as a binder resin.

8. The developer according to claim 6, wherein said toner is a positively chargeable toner containing a styrene-acrylic resin as a binder resin.

9. A method of developing an electrostatic latent image, comprising:

electrostatically charging a surface of a rotating hollow cylindrical photosensitive drum to a uniform potential;

exposing the electrostatically charged portion of said image-bearing member to a light image of original informational data being reproduced to form an electrostatic latent image corresponding to said original informational data;

transporting a magnetic developer comprising a magnetic carrier and a toner to a developing zone defined by a gap between said photosensitive drum and a non-magnetic, hollow cylindrical sleeve containing inside thereof a permanent magnet roll having a plurality of magnetic poles on the surface thereof, said magnetic developer being attracted on the surface of said sleeve and transported to said developing zone by a rotation of said sleeve;

developing said latent image by bringing said magnetic developer into contact therewith in said developing zone to form a toner image on said image-bearing member while applying a bias voltage between said photosensitive drum and said sleeve, said bias voltage being D.C. bias voltage superimposed with A.C. bias voltage having a peak-to-peak voltage of 500 V to 2.5 kV and a frequency of 100 Hz to 10 kHz;

said magnetic carrier being an Li—Mn ferrite carrier comprising 2 to 15 mol % of $Li_2O$, 5 to 30 mol % of MnO and 60 to 90 mol % of $Fe_2O_3$, each molar percentage being based on the total of $Li_2O$, MnO and $Fe_2O_3$, and having a specific volume resistivity of $10^5$ to $10^{13}$ Ω.cm when measured at an electric field of 200 V/cm, a specific surface area of 0.03 to 0.5 m$^2$/g, and an average particle size of 10 to 150 μm.

10. The ferrite carrier according to claim 2, wherein said sintering aid is at least one selected from the group consisting of $Na_2O$ and $Al_2\mathbf{0}_3$.

11. The ferrite carrier according to claim 1, wherein a bulk density of said ferrite carrier is 1.4 to 3.3 g/cm$^3$.

12. The ferrite carrier according to claim 1, wherein a fluidity index of said carrier is 5 to 120 s/50 g.

13. The ferrite carrier according to claim 3, further comprising at least one sintering aid selected from the group consisting of CaO, $Na_2O$, $SiO_2$, $V_2O_5$, $Al_2O_3$, $As_2O_3$, $Bi_2O_3$, $Sb_2O_3$ and $B_2O_3$ in an amount of 0.1 to 1.2 weight % based on the total of $Li_2O$, MnO, and $Fe_2O_3$.

14. The ferrite carrier according to claim 13, wherein said sintering aid is at least one selected from the group consisting of CaO, $Na_2O$, $SiO_2$, $V_2O_5$, and $Al_2O_3$.

* * * * *